US012089638B2

(12) United States Patent
Jeong et al.

(10) Patent No.: US 12,089,638 B2
(45) Date of Patent: Sep. 17, 2024

(54) VAPORIZER AND AEROSOL-GENERATING DEVICE INCLUDING THE SAME

(71) Applicant: KT&G CORPORATION, Daejeon (KR)

(72) Inventors: Jong Seong Jeong, Seoul (KR); Chul Ho Jang, Daejeon (KR); Gyoung Min Go, Daejeon (KR); Hyung Jin Bae, Daejeon (KR); Jang Won Seo, Daejeon (KR); Min Seok Jeong, Seoul (KR); Jin Chul Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 466 days.

(21) Appl. No.: 17/431,475

(22) PCT Filed: Dec. 8, 2020

(86) PCT No.: PCT/KR2020/017846

§ 371 (c)(1),
(2) Date: Aug. 17, 2021

(87) PCT Pub. No.: WO2021/153895

PCT Pub. Date: Aug. 5, 2021

(65) Prior Publication Data

US 2022/0132925 A1 May 5, 2022

(30) Foreign Application Priority Data

Jan. 31, 2020 (KR) ..... 10-2020-0011897
Mar. 2, 2020 (KR) ..... 10-2020-0025928

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/42* (2020.01); *A24F 40/46* (2020.01)

(58) Field of Classification Search
CPC ..... A24F 40/44; A24F 40/10; A24F 40/42; A24F 40/46; A24F 40/40; A24F 40/50
See application file for complete search history.

(56) References Cited

U.S. PATENT DOCUMENTS 11,272,737 B2 * 3/2022 Watanabe ..... H05B 3/06
2004/0033171 A1 2/2004 Kvietok et al.
(Continued)

FOREIGN PATENT DOCUMENTS

CN 104307020 A 1/2015
CN 105208882 A 12/2015
(Continued)

OTHER PUBLICATIONS

Office Action dated Apr. 27, 2023 from the Chinese Patent Office in Application No. 202080019996.4.
(Continued)

*Primary Examiner* — Truc T Nguyen
(74) *Attorney, Agent, or Firm* — Sughrue Mion, PLLC

(57) ABSTRACT

A vaporizer and an aerosol-generating device including the vaporizer are provided. The vaporizer includes a liquid storage tank configured to store a liquid aerosol-generating material, and a wick-heater assembly including a porous wick that absorbs the stored aerosol-generating material through a porous body and a heater assembly that generates an aerosol by heating the absorbed aerosol-generating material.

17 Claims, 10 Drawing Sheets

(51) Int. Cl.
*A24F 40/42* (2020.01)
*A24F 40/46* (2020.01)

(56) References Cited

U.S. PATENT DOCUMENTS

| | | | | |
|---|---|---|---|---|
| 2014/0238424 | A1 | 8/2014 | Macko et al. | |
| 2016/0073695 | A1* | 3/2016 | Sears | H05B 3/46 131/329 |
| 2017/0188626 | A1 | 7/2017 | Davis et al. | |
| 2017/0265517 | A1 | 9/2017 | Swede et al. | |
| 2018/0042301 | A1 | 2/2018 | Rostami | |
| 2018/0177240 | A1 | 6/2018 | Duque et al. | |
| 2018/0184712 | A1 | 7/2018 | Fraser et al. | |
| 2018/0192700 | A1 | 7/2018 | Fraser et al. | |
| 2018/0279686 | A1 | 10/2018 | Macko et al. | |
| 2018/0360119 | A1 | 12/2018 | Kuwa et al. | |
| 2019/0133186 | A1 | 5/2019 | Fraser | |
| 2019/0274356 | A1* | 9/2019 | Deng | A24F 40/485 |
| 2019/0350256 | A1* | 11/2019 | Hejazi | A24F 40/46 |
| 2020/0069030 | A1* | 3/2020 | Barfod et al. | A61M 16/00 |
| 2020/0352238 | A1 | 11/2020 | Simpson et al. | |
| 2020/0359692 | A1* | 11/2020 | Liu | A24F 40/485 |
| 2020/0367557 | A1* | 11/2020 | Lin | A24F 40/42 |
| 2020/0367572 | A1* | 11/2020 | Hejazi | A61M 15/0028 |
| 2021/0185770 | A1 | 6/2021 | Sur | |
| 2021/0204601 | A1 | 7/2021 | Macko et al. | |
| 2022/0400756 | A1 | 12/2022 | Jeong et al. | |
| 2023/0189893 | A1* | 6/2023 | Xie | A24F 40/40 131/329 |
| 2024/0000134 | A1* | 1/2024 | Fu | A24D 1/14 |

FOREIGN PATENT DOCUMENTS

| | | | |
|---|---|---|---|
| CN | 108236131 | A | 7/2018 |
| CN | 109068723 | A | 12/2018 |
| CN | 113490431 | A | 10/2021 |
| EP | 3524069 | A1 | 8/2019 |
| JP | 2019-527559 | A | 10/2019 |
| KR | 10-2016-0040440 | A | 4/2016 |
| KR | 10-2018-0121666 | A | 11/2018 |
| KR | 10-2018-0129957 | A | 12/2018 |
| KR | 10-2019-0120310 | A | 10/2019 |
| WO | 2018/125934 | A1 | 7/2018 |

OTHER PUBLICATIONS

Extended European Search Report dated Feb. 10, 2022 in European Application No. 20916636.2.

International search report for PCT/KR2020/017846 dated Mar. 26, 2021.

Written opinion for PCT/KR2020/017846 dated Mar. 26, 2021.

Office Action dated Apr. 7, 2022 from the Korean Intellectual Property Office in KR Application No. 10-2020-0025928.

Office Action dated Oct. 18, 2022 issued by the Japanese Patent Office in Japanese Application No. 2021-555047.

Office Action issued Feb. 8, 2024 in Chinese Application No. 202080019996.4.

* cited by examiner

[Fig. 1]
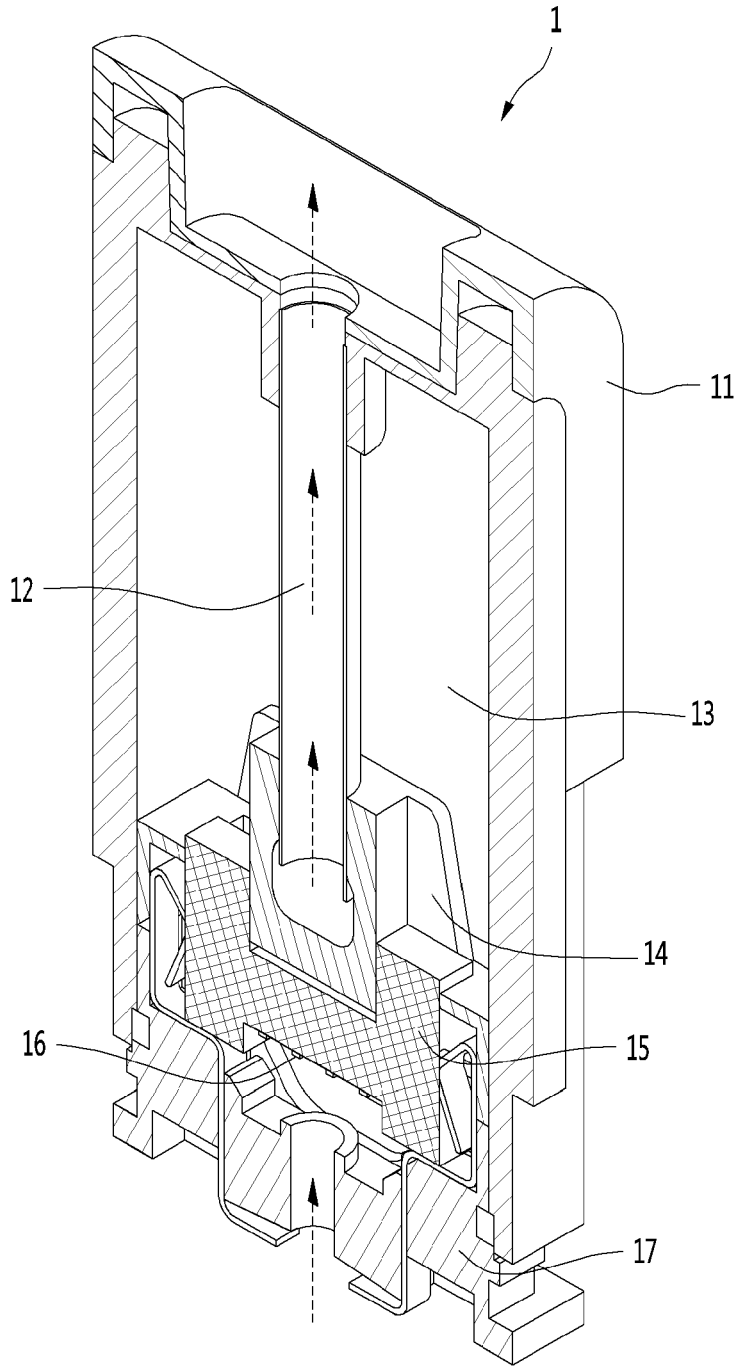

[Fig. 2]
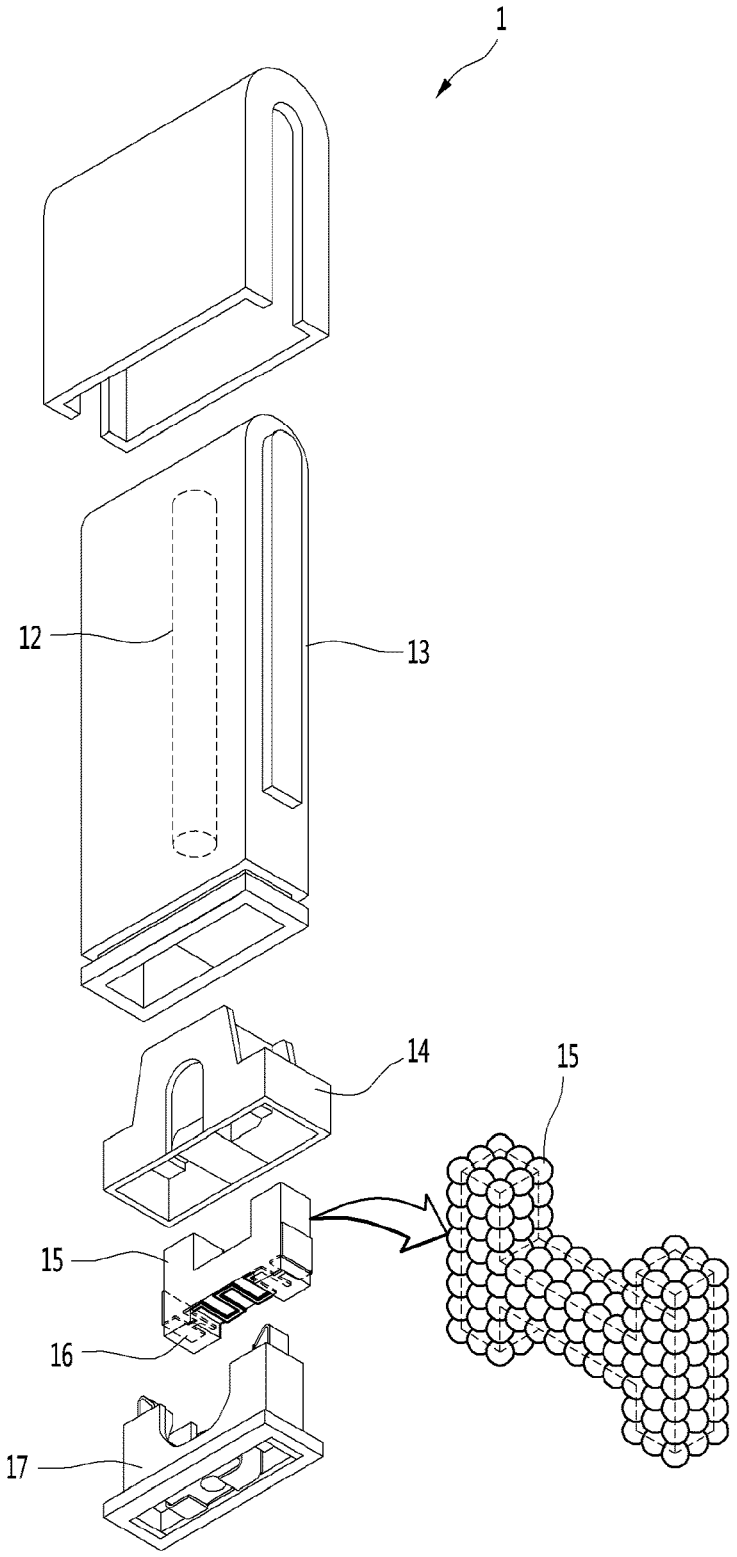

[Fig. 3]
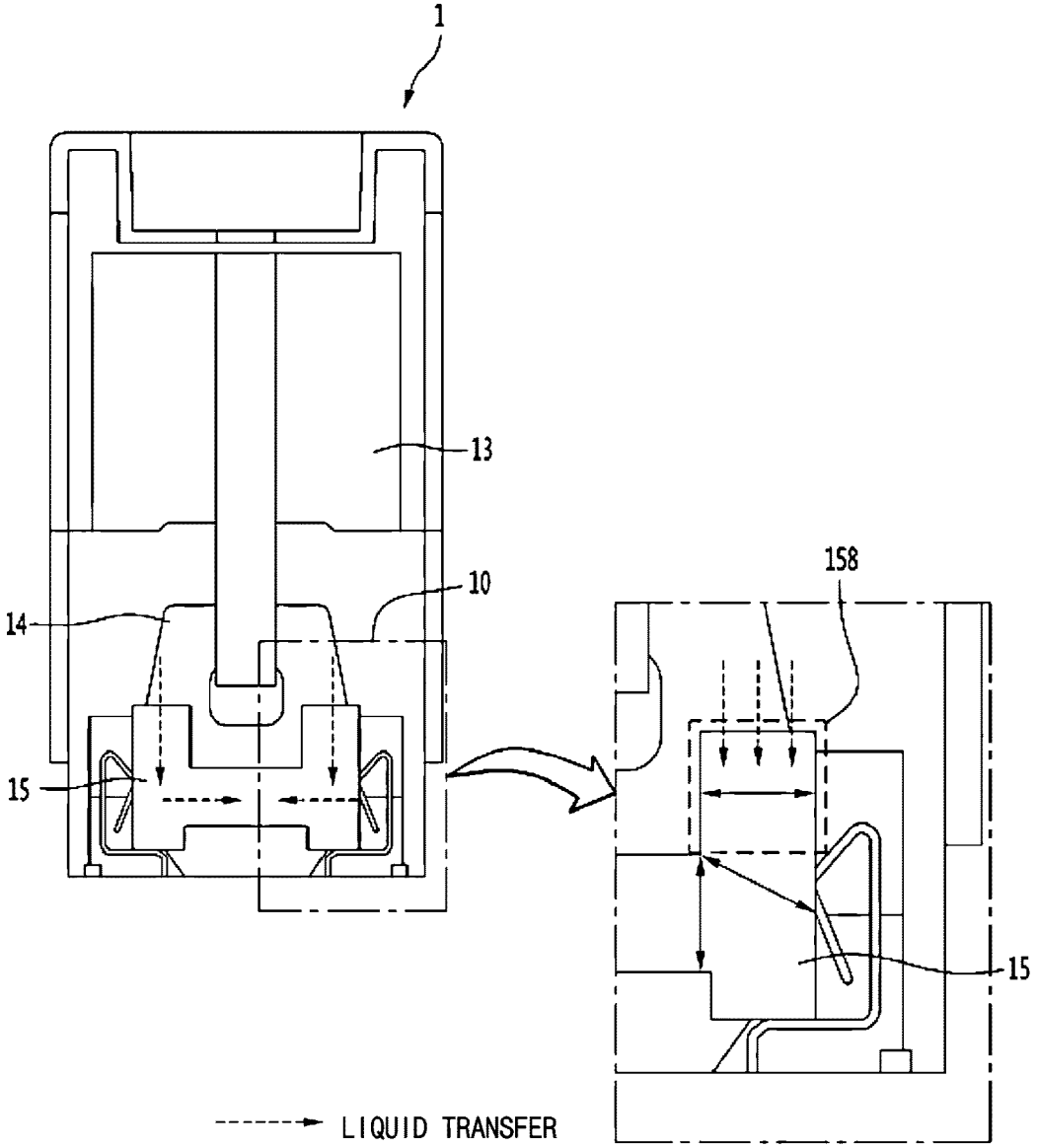

[Fig. 4]
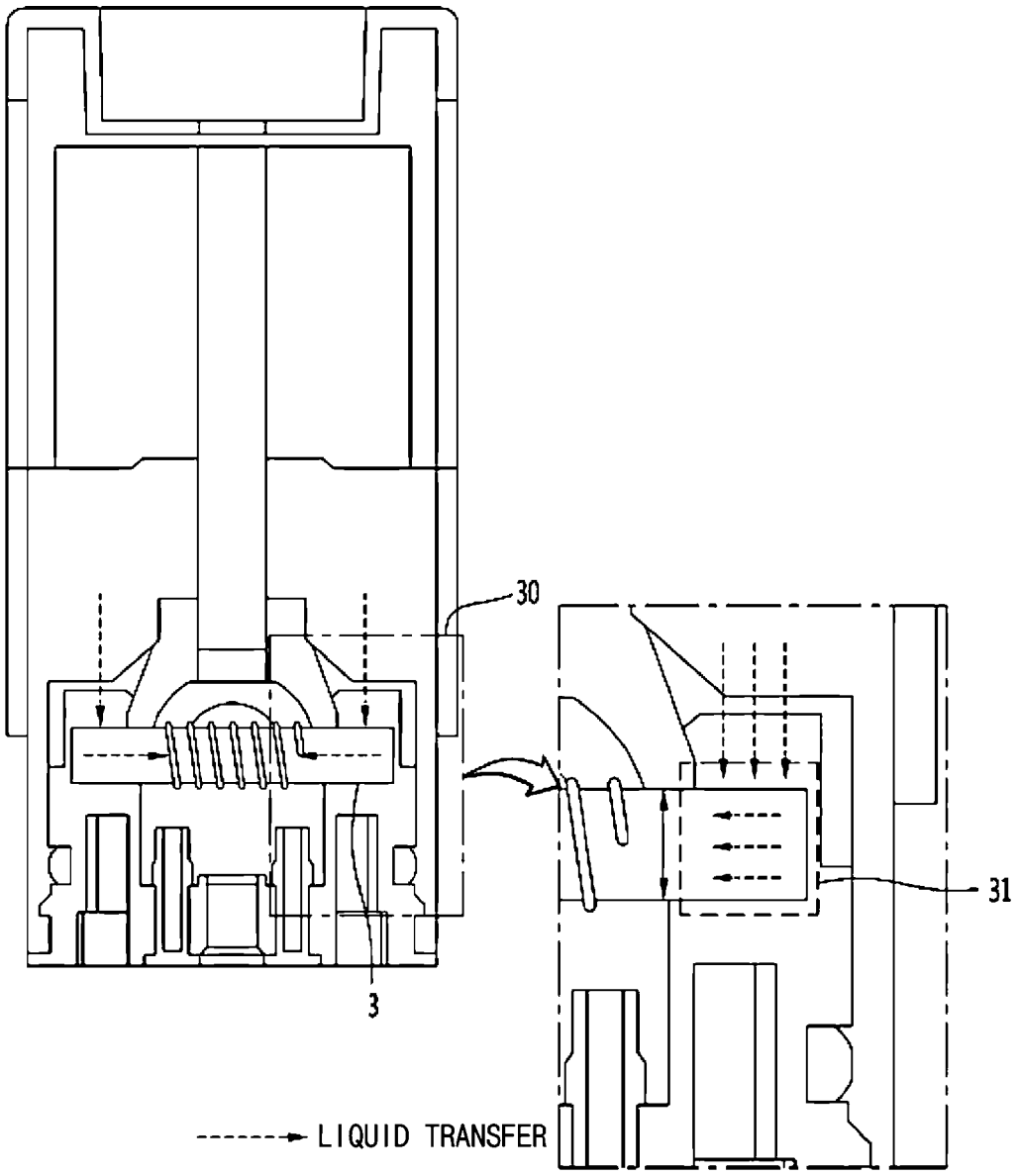

[Fig. 5]
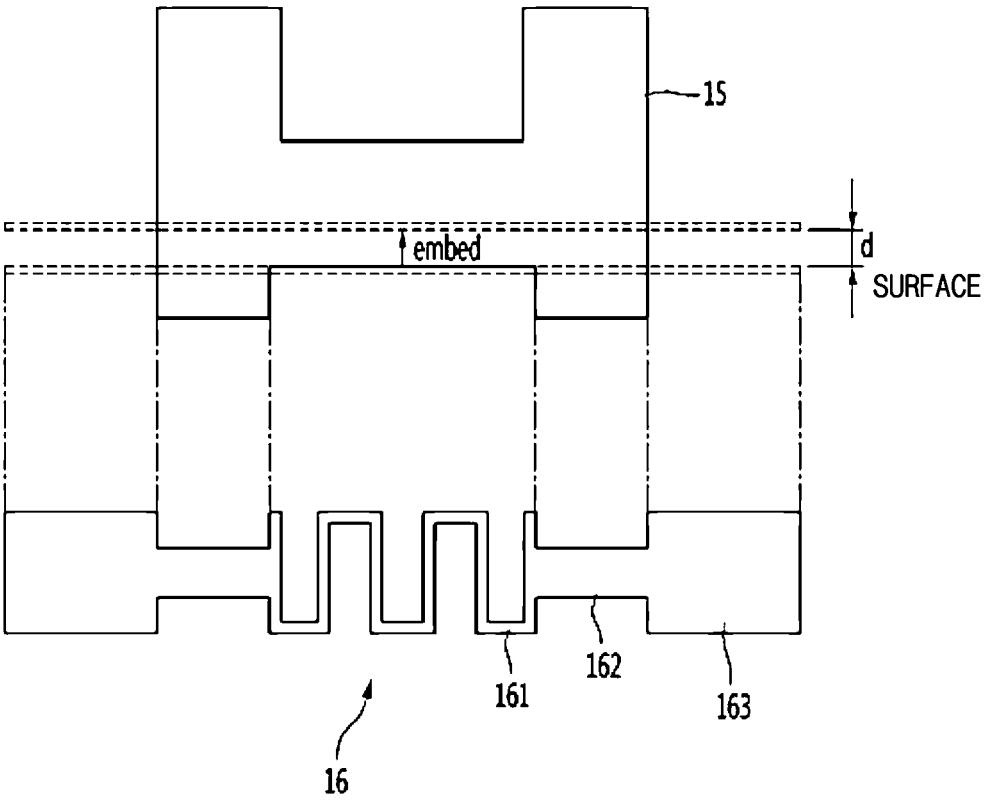
[Fig. 6]
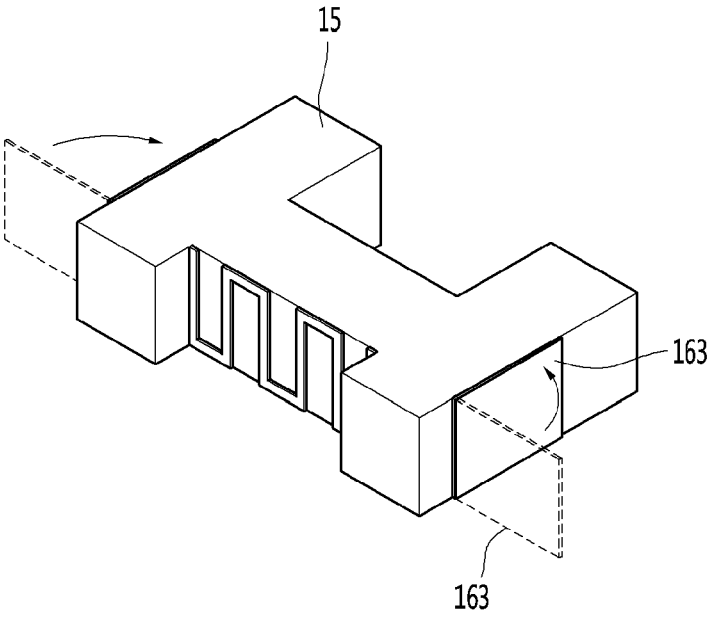

[Fig. 7]
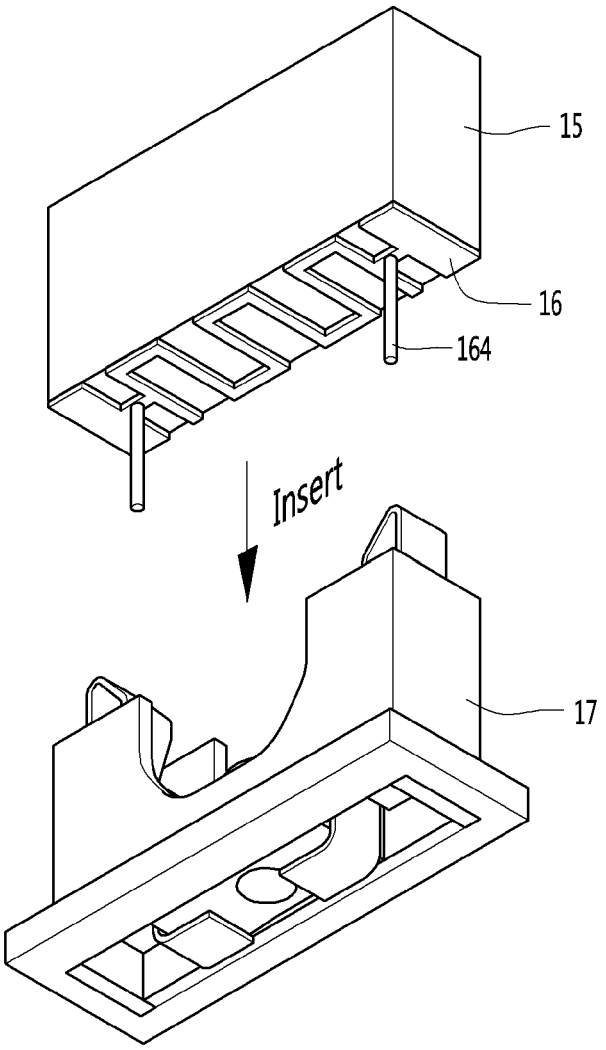
[Fig. 8]
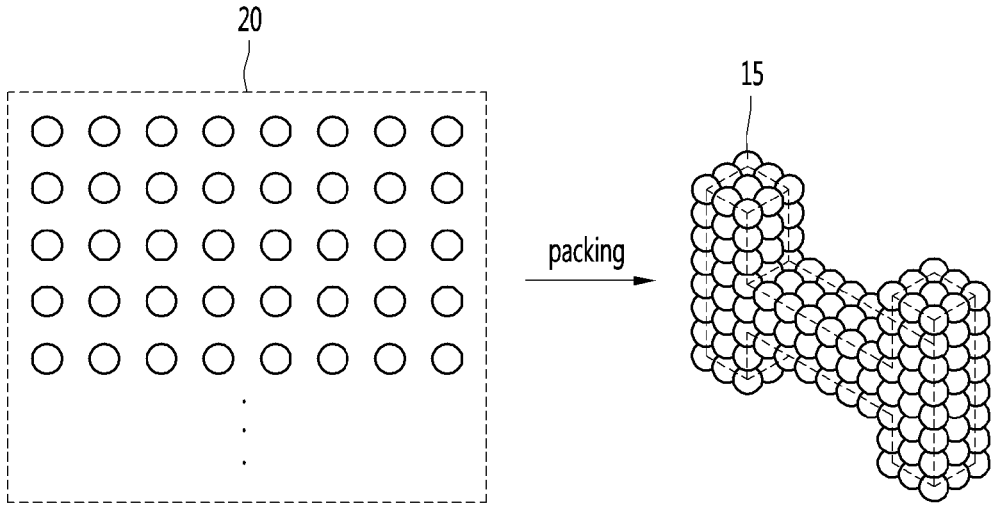

[Fig. 9]
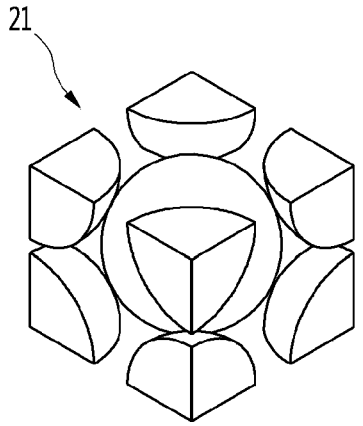
[Fig. 10]
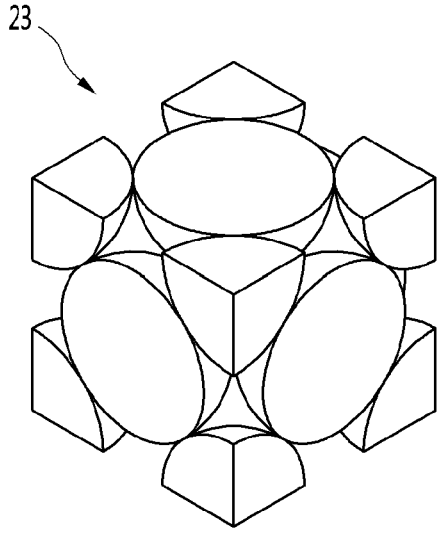
[Fig. 11]
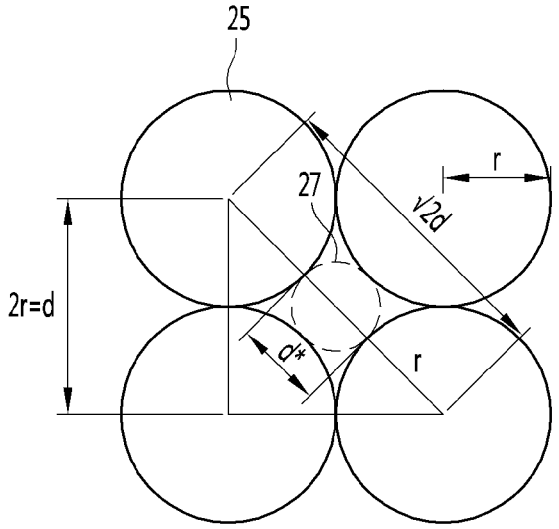

[Fig. 12]
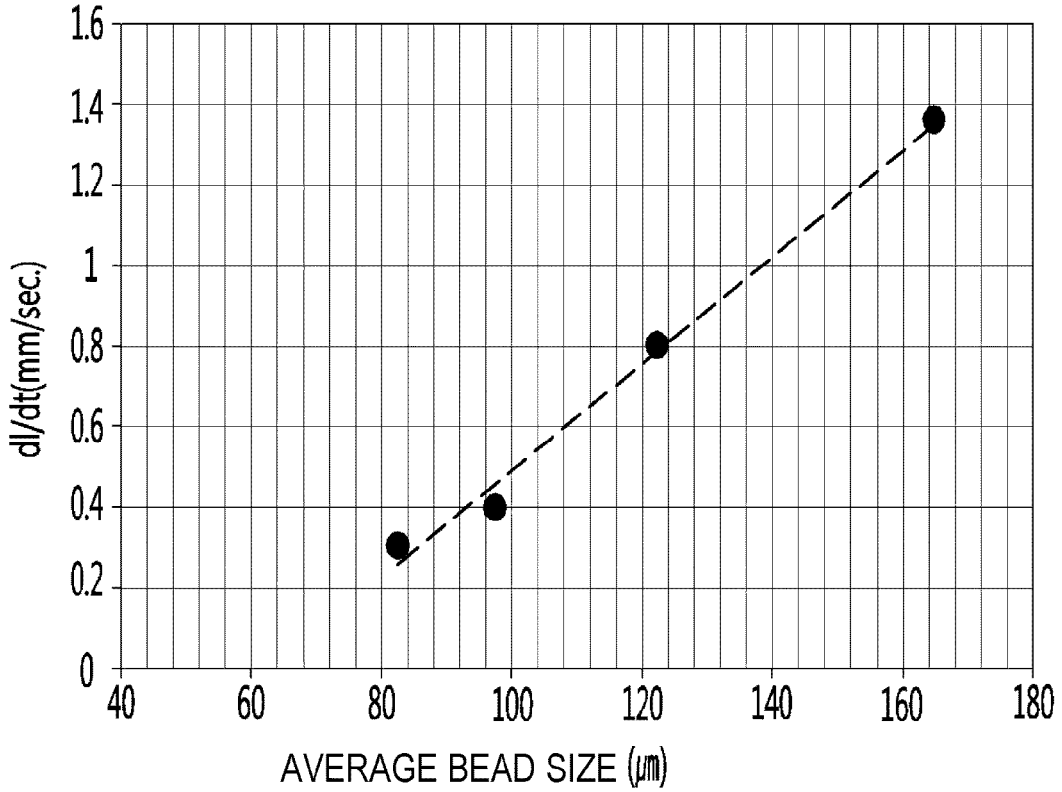
[Fig. 13]
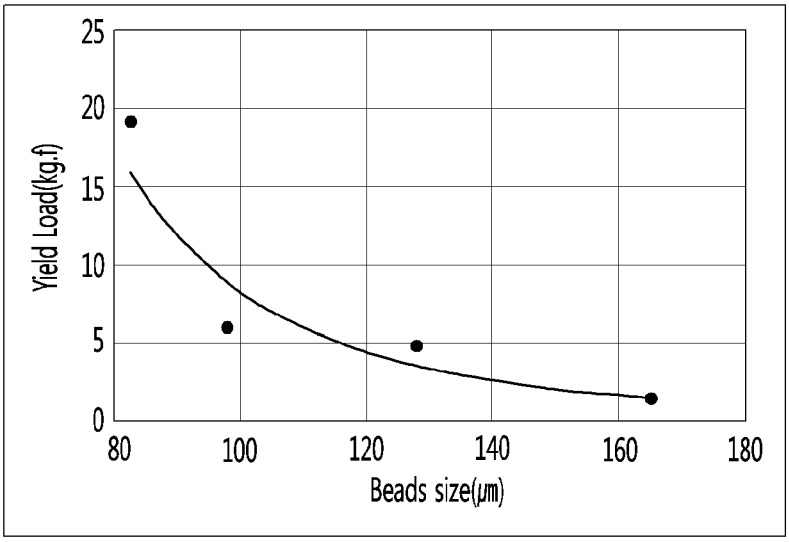

[Fig. 14]
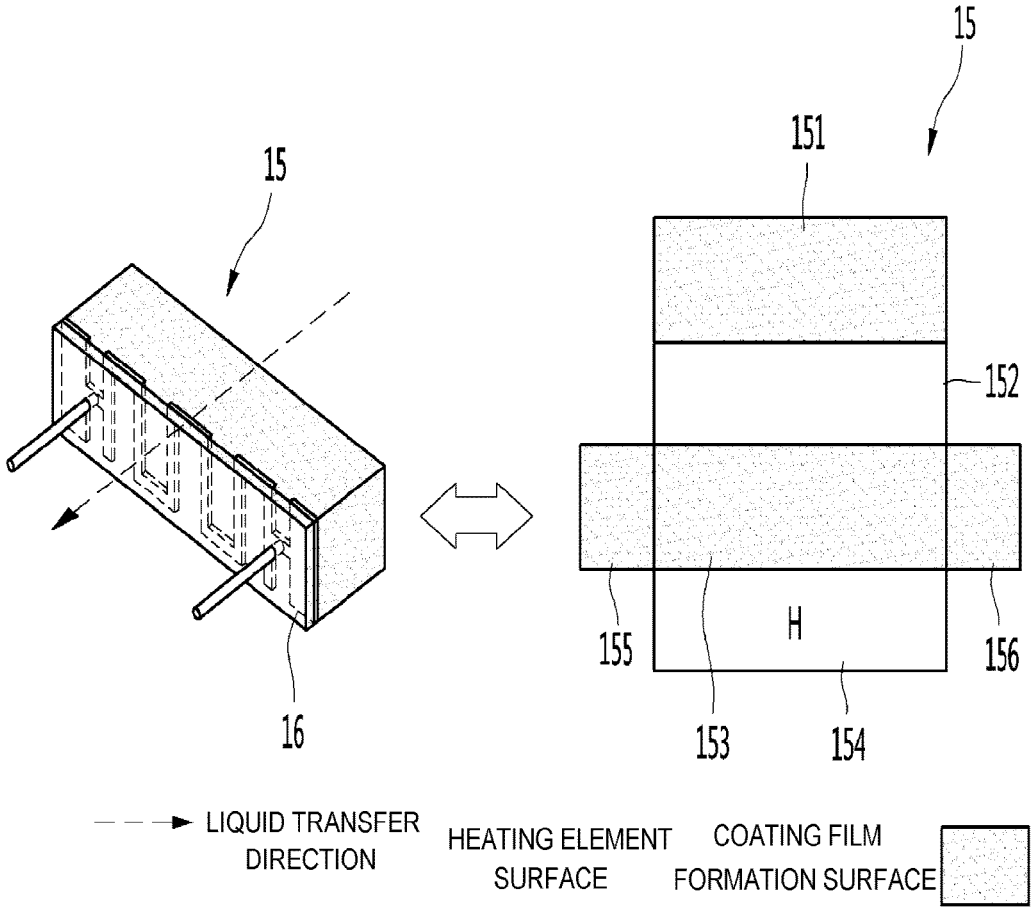
[Fig. 15]
100-1
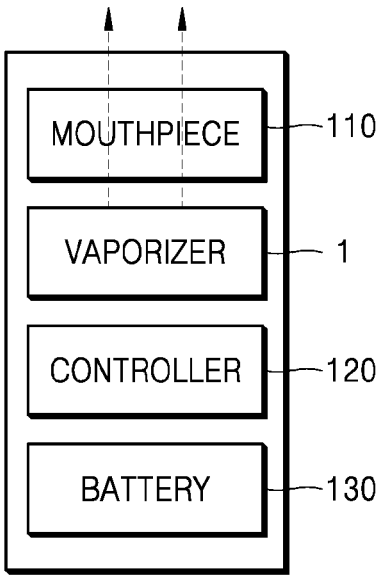

[Fig. 16]
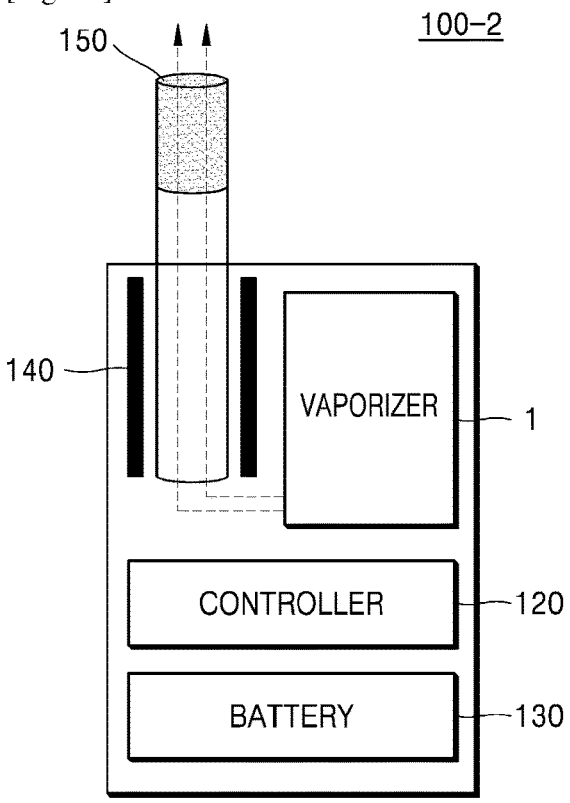
[Fig. 17]
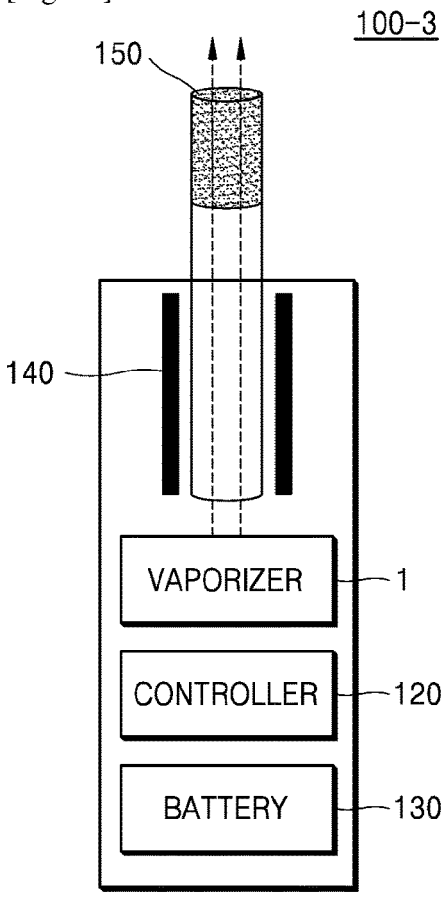

VAPORIZER AND AEROSOL-GENERATING DEVICE INCLUDING THE SAME

TECHNICAL FIELD

The present disclosure relates to a vaporizer and an aerosol-generating device including the vaporizer. More specifically, the present disclosure relates to a vaporizer that is capable of ensuring uniformity of a liquid transfer rate and the amount of liquid transfer and may be easily manufactured, and an aerosol-generating device including the vaporizer.

BACKGROUND ART

In recent years, the demand for alternative smoking articles that overcome the shortcomings of general cigarettes has increased. For example, the demand for an aerosol-generating device (e.g., a liquid electronic cigarette) that generates an aerosol by vaporizing a liquid composition instead of combusting a cigarette has increased, and accordingly, studies on a liquid vaporization-type aerosol-generating device have been actively conducted.

In a liquid vaporization-type aerosol-generating device, a wick is one of the key components of the device, which absorbs a liquid and delivers the absorbed liquid to a heater assembly. The wick is usually made of a fiber bundle including cotton or silica.

However, because the fiber bundle has a structure in which pore distribution is uneven and pore control is impossible, a wick implemented by the fiber bundle may not guarantee the uniformity of a liquid transfer rate and the amount of liquid transfer. In addition, due to this, the amount of atomization may vary greatly depending on the wick, and a phenomenon in which burning of a liquid causes a burnt taste may also occur frequently.

DISCLOSURE

Technical Problem

One or more embodiments of the present disclosure provide a porous wick capable of ensuring uniformity of a liquid transfer rate and the amount of liquid transfer.

One or more embodiments of the present disclosure provide a vaporizer capable of ensuring uniformity of the amount of aerosol generation and an aerosol-generating device including the vaporizer.

One or more embodiments of the present disclosure provide a vaporizer having a structure that may be easily manufactured and an aerosol-generating device including the vaporizer.

One or more embodiments of the present disclosure provide an optimal coupling structure between a wick and a heater assembly, which is capable of increasing the amount of aerosol generation and reducing the risk of damage and carbonization of the wick.

One or more embodiments of the present disclosure provide a vaporizer to which an optimal coupling structure between a wick and a heater assembly is applied, and an aerosol-generating device including the vaporizer.

Technical goals of the present disclosure are not limited to the above-mentioned technical goals, and other technical goals that are not mentioned may be clearly understood by one of ordinary skill in the technical field of the present disclosure from the following descriptions.

Technical Solution

To solve the technical problem described above, a vaporizer according to one or more embodiments may comprise a liquid storage tank configured to store a liquid aerosol-generating material, and a wick-heater assembly including a porous wick that absorbs the stored aerosol-generating material through a porous body and a heater assembly that generates an aerosol by heating the absorbed aerosol-generating material.

Advantageous Effects

According to various embodiments of the present disclosure described above, a vaporizer capable of increasing the amount of aerosol generation and being easily manufactured, and an aerosol-generating device including the vaporizer may be provided. For example, a wick-heater assembly is inserted into a lower case rather than being bonded to the lower case, so the vaporizer may be easily manufactured and the defect rate thereof may be reduced.

In addition, by manufacturing a wick by packing a plurality of beads, a porous wick having a uniform pore size and/or distribution may be formed. Accordingly, a uniform liquid transfer rate and liquid transfer amount may be ensured, and an atomization amount of the vaporizer (or aerosol-generating device) may be uniformly maintained. Furthermore, carbonization of the porous wick may be reduced.

In addition, a coating film may be formed on some surfaces, which are not related to a target transfer path of the liquid aerosol generating material, from among a plurality of surfaces forming the body of the porous wick. Accordingly, the transfer of a liquid may be concentrated on the target transfer path. In addition, as the transfer of the liquid is concentrated on the target transfer path, the liquid supply capability of the porous wick and the atomization amount of the vaporizer (or aerosol-generating device) may be greatly increased.

Furthermore, a heater assembly may be embedded between about 0 μm and about 400 μm from the surface of the body of the porous wick. Thus, the amount of aerosol generation may be increased, and the risk of damaging the porous wick may be reduced.

In addition, a terminal electrically connected to a heating pattern may be arranged to be in close contact with both sides of the body of the porous wick. Accordingly, a space occupied by the heater assembly may be reduced, and thus, the vaporizer or aerosol-generating device may be manufactured in a more compact form. In addition, a problem that the amount of aerosol generation decreases due to a terminal obstructing airflow may be solved.

Effects according to the technical idea of the present disclosure are not limited to the above-mentioned effects, and other effects that are not mentioned may be clearly understood by one of ordinary skill in the technical field of the present disclosure from the following descriptions.

DESCRIPTION OF DRAWINGS

FIG. 1 is a configuration view of a vaporizer according to an embodiment of the present disclosure;

FIG. 2 is an exploded view of a vaporizer according to an embodiment of the present disclosure;

FIGS. 3 and 4 are views illustrating the shapes of porous wicks according to some embodiments of the present disclosure;

FIG. 5 is a view illustrating a coupling structure between a porous wick and a heater assembly, according to an embodiment of the present disclosure;

FIG. 6 is a view illustrating a terminal for supplying electric power to a wick-heater assembly according to an embodiment of the present disclosure;

FIG. 7 is a view illustrating a coupling structure between a wick-heater assembly and a lower case, according to an embodiment of the present disclosure;

FIG. 8 is a view illustrating a method of manufacturing a porous wick according to an embodiment of the present disclosure;

FIGS. 9 and 10 are views illustrating packing structures that may be applied to a porous wick according to some embodiments of the present disclosure;

FIG. 11 is a view illustrating a relationship between bead size and pore size;

FIG. 12 is a graph showing for a relationship between bead size and a liquid transfer rate of a porous wick;

FIG. 13 is a graph showing a relationship between bead size and strength of a porous wick;

FIG. 14 are a perspective view and an unfolded view of a porous wick according to an embodiment of the present disclosure; and FIGS. 15 to 17 are block diagrams illustrating aerosol-generating devices according to some embodiments of the present disclosure.

BEST MODE

According to one or more embodiments, a vaporizer comprises a liquid storage tank configured to store a liquid aerosol-generating material, and a wick-heater assembly including a porous wick that absorbs the stored aerosol-generating material through a porous body and a heater assembly that generates an aerosol by heating the absorbed aerosol-generating material.

The heater assembly may include a heating pattern embedded in the porous body, the heating pattern having a flat shape, wherein the heating pattern may be embedded in a position distanced from a center of the porous body.

The heating pattern may be embedded at a position which is about 0 μm to about 400 μm apart in an upward direction from a lower surface of the porous body.

The vaporizer may further comprise a wick housing located above the wick-heater assembly and coupled with the wick-heater assembly and the liquid storage tank, and a lower case located under the wick-heater assembly and coupled with the wick-heater assembly, wherein the lower case includes a groove and the wick-heater assembly includes a protruding member such that the lower case and the wick-heater assembly are coupled with each other by the protruding member being inserted into the groove.

The heater assembly may include one or more terminals electrically connected to a battery, wherein the one or more terminals may be arranged to be in close contact with the porous body.

The porous body may be formed by a plurality of beads.

Each of the plurality of beads may be a ceramic bead.

The diameter of each of the plurality of beads may be about 10 μm to about 300 μm.

The diameter of each of the plurality of beads may be about 70 μm to about 100 μm.

A diameter distribution of the plurality of beads may have deviations within 20% of an average diameter of the plurality of beads.

The porous body may be formed through a process of determining a diameter of each of the plurality of beads based on viscosity of the aerosol-generating material, and a process of packing the plurality of beads each having the determined diameter.

The porous body may be formed through a process of determining a diameter of each of the plurality of beads based on the content of glycerin contained in the aerosol-generating material, and a process of packing the plurality of beads each having the determined diameter.

The vaporizer may further comprise an airflow pipe arranged above the wick-heater assembly and transferring the generated aerosol, wherein the heater assembly may be arranged under the porous body to form the wick-heater assembly.

The liquid storage tank may be arranged above the wick-heater assembly, and both sides of the porous body protrude in an upward direction into the liquid storage tank such that the stored liquid aerosol-generating material is absorbed through the sides of the porous body.

A coating film, which blocks or limits absorption of the aerosol-generating material, may be formed on a surface of at least a portion of the porous body, wherein the surface is no on an absorption path of the stored liquid aerosol-generating material.

MODE FOR INVENTION

Hereinafter, preferable embodiments of the present disclosure will be described in detail with reference to the accompanying drawings. Advantages and features of the present disclosure, and methods of achieving the same will be clearly understood with reference to the following embodiments described in detail in conjunction with the accompanying drawings. However, the technical idea of the present disclosure is not limited to the embodiments set forth herein and may be embodied in various different forms. The embodiments are provided so that the technical idea of the present disclosure will be thorough and complete, and will fully convey the scope of the present disclosure to one of ordinary skill in the art, and the technical idea of the present disclosure is defined by the scope of the claims.

In adding reference numerals to elements of each drawing, it should be noted that the same reference numerals are assigned to the same elements as possible even if they are indicated on different drawings. In addition, in describing the present disclosure, when it is determined that a detailed description of a related known configuration or function may obscure the subject matter of the present disclosure, a detailed description thereof will be omitted.

Unless otherwise defined, all terms (including technical and scientific terms) used in the present specification may be used as meanings that may be commonly understood by one of ordinary skill in the art to which the present disclosure belongs. In addition, unless explicitly and specifically defined, terms defined in generally-used dictionaries are not ideally or excessively interpreted. Terms used in the present specification are for describing embodiments and are not intended to limit the present disclosure. In the present specification, unless specifically mentioned in the context, singular forms may also include plural forms.

In addition, in describing the elements of the present disclosure, terms such as first, second, A, B, (a) and (b) may be used. These terms are only for distinguishing an element from other elements, and the nature or order of the element is not limited by the terms. When an element is described as being "connected", "coupled" or "bonded" to another element, the element may be directly connected, coupled or bonded to the other element, but it should be understood that another element may be connected, coupled, or bonded between the element and the other element.

"Comprises", "includes", "comprising", and/or "including" used in the specification does not exclude existence or addition of one or more other elements, steps, operations and/or devices in addition to the mentioned elements, steps, operations, and/or devices.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Prior to the description of various embodiments of the present disclosure, some terms used in the present specification will be clarified.

In the present specification, "aerosol-generating material" may refer to a material capable of generating an aerosol. The aerosol may include a volatile compound. The aerosol-generating material may be solid or liquid.

For example, a solid aerosol-generating material may include a solid material based on tobacco raw materials such as reconstituent tobacco sheet, pipe tobacco, and reconstituted tobacco, and a liquid aerosol-generating material may include a liquid composition based on nicotine, tobacco extract, and/or various flavoring agents. However, the scope of the present disclosure is not limited to examples listed above.

As a more specific example, the liquid aerosol-generating material may include at least one of propylene glycol (PG) and glycerin (GLY), and may further include at least one of ethylene glycol, dipropylene glycol, diethylene glycol, triethylene glycol, tetraethylene glycol, and oleyl alcohol. As another example, the aerosol-generating material may further include at least one of nicotine, moisture, and flavoring material. As another example, the aerosol-generating material may further include various additives such as cinnamon and capsaicin. The aerosol-generating material may include a liquid material having high flowability as well as a material in the form of a gel or solid. As described above, the compositional component of the aerosol-generating material may be variously selected according to embodiments, and the composition ratio thereof may also vary according to embodiments. In the following specification, "liquid" may be understood to refer to a liquid aerosol-generating material.

In the present specification, "aerosol-generating device" may refer to a device that generates an aerosol by using an aerosol-generating material to generate an aerosol that may be directly inhaled into a user's lungs through the user's mouth. The aerosol-generating device may include, for example, a liquid aerosol-generating device using a vaporizer, and a hybrid aerosol-generating device using both a vaporizer and a cigarette. In addition, the aerosol-generating device may further include any of various types of aerosol-generating devices, and thus, the scope of the present disclosure is not limited to examples listed above. Some examples of the aerosol-generating device will be described with reference to FIGS. 15 to 17.

In the present specification, "puff" may refer to inhalation of a user, and inhalation may refer to a situation in which an aerosol is drawn into the user's oral cavity, nasal cavity, or lungs through the user's mouth or nose.

Hereinafter, various embodiments of the present disclosure will be described in detail with reference to the accompanying drawings.

FIG. 1 is a configuration diagram illustrating a vaporizer 1 according to an embodiment of the present disclosure, and FIG. 2 is an exploded view illustrating the vaporizer 1. In FIG. 1, dotted arrows indicate a delivery path of air or an aerosol.

As shown in FIGS. 1 and 2, the vaporizer 1 may include an upper case 11, an airflow pipe 12, a liquid storage tank 13, a wick housing 14, a porous wick 15, a heater assembly 16, and a lower case 17. However, some components related to the embodiment of the present disclosure are only shown in FIG. 1. Accordingly, those of ordinary skill in the art to which the present disclosure belongs may recognize that other general-purpose components may be further included in addition to the components shown in FIG. 1.

In addition, all of the components 11 to 17 shown in FIG. 1 may not be essential components of the vaporizer 1. That is, in some other embodiments of the present disclosure, at least some of the components shown in FIG. 1 may be omitted or replaced with other components. Hereinafter, each component of the vaporizer 1 will be described.

The upper case 11 may serve as a cover or a housing of the upper portion of the vaporizer 1. In some embodiments, the upper case 11 may also serve as a mouthpiece.

The airflow pipe 12 may serve as an airflow path for air and/or an aerosol. For example, an aerosol generated by the heater assembly 16 may be discharged in a direction toward the upper case 11 through the airflow pipe 12 and may be inhaled by a user. However, FIG. 1 only assumes that the user's suction is performed in a direction toward the top of the vaporizer 1, and the shape and delivery path of the airflow pipe 12 may be modified according to the design of the aerosol-generating device and/or the airflow pipe 12.

The liquid storage tank 13 may have a certain space therein and store a liquid aerosol-generating material in the space. In addition, the liquid storage tank 13 may supply the stored aerosol-generating material to the heater assembly 16 through the porous wick 15.

The wick housing 14 may be arranged between the liquid storage tank 13 and the porous wick 15 and may refer to a housing surrounding at least a portion of the porous wick 15. The porous wick 15 may form a wick-heater assembly together with the heater assembly 16, and the wick housing 14 may be located above the wick-heater assembly. In addition, the wick housing 14 may be combined with the wick-heater assembly 16 located below the wick housing 14 and the liquid storage tank 13 located above the wick housing 14.

The porous wick 15 may absorb the aerosol-generating material, which is stored in the liquid storage tank 13, through a porous body and transfer the absorbed aerosol-generating material to the heater assembly 16. Although FIGS. 1 and 2 illustrate an example in which the porous wick 15 has an H-shaped body, the porous wick 15 may be designed and implemented in various forms. For example, the porous wick 15 may be implemented to have a porous body having a rectangular parallelepiped shape (see FIG. 7 or 14).

In some embodiments, both sides of the porous wick 15 may have a shape (e.g., H or U shape) protruding toward the liquid storage tank 13 and may absorb a liquid through both protruding sides. In this case, because a liquid absorption area increases, the liquid transfer capability of the porous wick 15 may increase. The present embodiment will be described in more detail with reference to FIGS. 3 and 4.

FIG. 3 illustrates a porous wick 15 according to an embodiment, and FIG. 4 illustrates a wick 3 having a straight shape. In addition, FIG. 3 shows an enlarged view of a side area 10 of the porous wick 15, and FIG. 4 shows an enlarged view of a side area 30 of the wick 3.

Compared with a liquid absorption area of the wick 3, the sides of the porous wick 15 protrude toward a liquid storage tank 13, and thus, a liquid may be absorbed through a relatively larger area (see an area 158 of FIG. 3 and an area 31 of FIG. 4). Accordingly, the porous wick 15 according to the embodiment may have a liquid transfer capability superior to that of the wick 3 having a straight shape.

In addition, in some embodiments, a coating film may be formed on at least a portion of the porous body of the wick. Preferably, a coating film may be formed on a surface that is not on a target transfer path of the liquid, from among a plurality of surfaces forming the porous body. The coating film may block or limit the movement of liquid such that liquid transfer may be concentrated to the target transfer path. This will be described in more detail with reference to FIG. 14 later.

In some embodiments, the porous body may be formed by a plurality of beads. For example, a porous body may be formed by sphere-packing a plurality of beads. According to the present embodiment, by packing the beads to form a porous body, a porous wick having a uniform pore distribution may be manufactured, and thus, uniformity of a liquid transfer rate of the porous wick and the amount of liquid transfer may be ensured. This will be described in more detail with reference to FIGS. 8 to 13.

Descriptions of the components of the vaporizer 1 will be continued with reference to FIGS. 1 and 2.

The heater assembly 16 may generate an aerosol by heating the aerosol-generating material absorbed by the porous wick 15.

In some embodiments, the heater assembly 16 may include a flat heating pattern 161 and a terminal 163 for receiving electricity from a battery (see FIG. 5). The heating pattern may be attached to or embedded in a lower portion of the body of the porous wick 15 to heat the absorbed liquid through bottom heating. In this case, because the heater assembly 16 may evenly heat the liquid absorbed by the porous wick 15, the amount of aerosol generation (i.e., the amount of atomization) may be greatly increased. An aerosol generated by heating may be inhaled by a user through the airflow pipe 12 arranged in an upward direction.

In some embodiments, as shown in FIG. 5, the heater assembly 16 may include a flat heating pattern 161, a terminal 163 for receiving electricity from a battery, and a connection member 162 for connecting the heating pattern 161 to the terminal 163. The connection member 162 may also fix the heater assembly 16 to the body of the porous wick 15. In this case, a problem that the heater assembly 16 attached to (or embedded in) the porous wick 15 is detached from the porous wick 15 due to damage to the porous wick 15 or weakening of adhesive strength may be solved.

In addition, in some embodiments, as shown in FIG. 5, the heater assembly 16 including the heating pattern 161 and the connection member 162 may be embedded in the body of the porous wick 15. For example, the heater assembly 16 may be embedded in a position distanced in a downward direction (i.e., toward the lower case 17) from a center of the body of the porous wick 15. As another example, the heater assembly 16 may be embedded in a position distanced in a lateral direction or an upward direction from the center of the body of the porous wick 15. The position of the heater assembly 16 may vary depending on embodiments, and may be determined in consideration of an inflow direction and/or a path of the airflow, the coupling structure between the porous wick 15 and the heater assembly 16, the structure of the vaporizer 1, etc.

Furthermore, in some embodiments, the heater assembly 16 may be embedded at a certain depth from the surface of the body of the porous wick 15. For example, as shown in FIG. 5, the heater assembly 16 may be embedded at a certain depth d from the lower surface of the body of the porous wick 15. In order to embed the heater assembly 16 in the porous wick 15, an in-mold molding technique may be used. However, the scope of the present disclosure is not limited thereto.

In the above-described embodiment, because the amount of aerosol generation and the risk of damage to the porous wick 15 vary according to an embedment depth, that is, the depth d, it may be important to appropriately determine the depth d. For example, as the heater assembly 16 is embedded closer to the surface of the porous wick 15 (i.e., as the depth d decreases), the amount of aerosol generation may increase. However, because the risk of damage to the porous wick 15 may also increase, it may be important to embed the heater assembly 16 at an appropriate depth.

In some embodiments, the depth d may be about 0 μm to about 400 μm. Preferably, the depth d may be about 50 μm to about 400 μm, about 0 μm to about 350 μm, about 50 μm to about 350 μm, or about 0 μm to about 300 μm. Alternatively, preferably, the depth d may be about 100 μm to about 300 μm, about 100 μm to about 250 μm, about 150 μm to about 350 μm, about 150 μm to about 300 μm, or about 150 μm to about 250 μm. When the heater assembly 16 and the porous wick 15 are combined with each other in this numerical range, an aerosol may be sufficiently generated and the risk of damage to the porous wick 15 may be reduced.

In addition, in some embodiments, the terminal 163 may be arranged to be in close contact with both sides of the body of the porous wick 15. For example, as shown in FIG. 6, the terminal 163 protruding in both side directions may be folded to be in close contact with the sides of the body of the porous wick 15. In this case, the space occupied by the heater assembly 16 may be reduced, and thus, the vaporizer 1 may be manufactured in a more compact form. In addition, it is possible to avoid the problem that the amount of aerosol generation is reduced due to a terminal obstructing airflow. For example, when the terminal 163 has a shape protruding in the downward direction (i.e., toward the lower case 17), the terminal 163 may hinder air inflow through an air hole of the lower case 17. However, in the vaporizer 1 according to some embodiments of the present disclosure, such a problem may be prevented.

Descriptions of the components of the vaporizer 1 will be continued with reference to FIGS. 1 and 2.

The lower case 17 is a housing located at the bottom of the vaporizer 1 and may support a lower portion of the vaporizer 1, the porous wick 15, the heater assembly 16, and the like. The porous wick 15 may form a wick-heater assembly together with the heater assembly 16, and the lower case 17 may be combined with the wick-heater assembly.

In some embodiments, the lower case 17 may include an air hole or an airflow pipe through which air is introduced toward the heater assembly 16 (see FIG. 1). In addition, in some embodiments, the lower case 17 may include a connection terminal for electrically connecting a terminal of the heater assembly 16 to a battery (see FIG. 1).

Furthermore, in some embodiments, the lower case 17 may include a groove, and the wick-heater assembly may include a protruding member (e.g., a stud). For example, as shown in FIG. 7, a protruding member 164 (e.g., a stud) protruding downward may be arranged on the wick-heater assembly. In this case, because the wick-heater assembly and the lower case 17 may be combined with each other in a simple assembly method in which the protruding member 164 is inserted into the groove member, the ease of manufacturing the vaporizer 1 may be improved. In addition, as a process of assembling the vaporizer 1 is simplified, a defect rate in a process of manufacturing the vaporizer 1 may be reduced.

In the above, the vaporizer 1 according to some embodiments of the present disclosure has been described with reference to FIGS. 1 to 7. Hereinafter, a porous wick 15 based on a bead assembly according to some embodiments of the present disclosure will be described with reference to FIGS. 8 to 13.

FIG. 8 illustrates a process of manufacturing the porous wick 15. As illustrated in FIG. 8, the porous wick 15 may be manufactured by packing a plurality of beads 20. For example, by sphere-packing and sintering the plurality of beads 20, a body of the porous wick 15 may be formed. The packing structure of the beads 20 may be, for example, a body-centered cubic (BCC) structure or a face-centered cubic (FCC) structure. However, in addition to the structures, various packing structures may be utilized, and thus, the scope of the present disclosure is not limited thereto. The FCC structure and the BCC structure refer to a structure 21 illustrated in FIG. 9 and a structure 23 illustrated in FIG. 10, respectively, and because the FCC structure and the BCC structure are well-known sphere packing structures in the art, descriptions thereof will be omitted.

When the porous wick 15 is made of a bead assembly, physical properties of the porous wick 15 such as porosity (i.e., porous ratio), pore size, pore distribution, and the like may be easily controlled based on a bead size, a packing method and/or a packing structure. For example, a porous wick having a porosity greater than or equal to a reference value and having a uniform pore distribution may be easily manufactured, and the manufactured porous wick may ensure uniformity of a liquid transfer rate and the amount of liquid transfer.

The material of beads for the porous wick may vary. For example, the material of the beads may be ceramic, and the ceramic beads may include glass ceramic beads or alumina ceramic beads. However, the scope of the present disclosure is not limited to examples listed above, and other materials may be used for the beads.

Because the size (e.g. diameter) of the bead is related to a liquid transfer rate and a wick strength, it may be important to properly determine the size of the bead. For example, in an octahedral site 27 illustrated in FIG. 11, a diameter d* of the octahedral site 27 is proportional (about 0.414 times) to a diameter d of a bead 25, and a tetrahedral site is also proportional to the diameter d of the bead 25. In addition, as the size of the pore increase, the liquid transfer rate increases, while the strength of the wick decreases. Therefore, it may be desirable to manufacture the wick with beads having an appropriate size.

For example, as shown in the experimental results of FIGS. 12 and 13, when the diameter of the bead increases, the liquid transfer rate of the wick may increase, while the strength of the wick may decrease. This is because, when the diameter of the bead increases, the size of the pore increases, and the number of beads per unit volume decreases. As a result, the number of contact interfaces decreases during sintering. In this respect, it may be important to properly determine the size of the bead in order to achieve both an appropriate wick strength and an appropriate liquid transfer rate.

In some embodiments, the diameter of the bead may be about 10 μm to about 300 μm. Preferably, the diameter of the bead may be about 30 μm to about 270 μm, or about 50 μm to about 250 μm. More preferably, the diameter of the bead may be about 60 μm to about 100 μm, about 65 μm to about 90 μm, about 70 μm to about 95 μm, about 75 μm to about 90 μm, about 80 μm to about 95 μm, about 75 μm to about 85 μm, or about 75 μm to about 80 μm. In these numerical ranges, a porous wick having an appropriate strength may be produced, and a liquid transfer rate in the porous wick may also be improved than that in a fiber bundle-based wick.

In addition, in some embodiments, the diameter distribution of a plurality of beads forming a porous wick may have deviations within 30% of a reference value (e.g., an average diameter of the plurality of beads). In other words, a tolerance (i.e., allowable variation of amount) of the diameter may be set to 30% of the average diameter. Preferably, the diameter distribution of the plurality of beads may have deviations within 25%, 23%, or 21%. More preferably, the diameter distribution of the plurality of beads may have deviations within 20%, 18%, 16%, 14%, 12%, or 10%. Even more preferably, the diameter distribution of the plurality of beads may have deviations within 8%, 6%, or 5%. Because it is not easy to continuously manufacture beads having the same diameter, costs and difficulties required for manufacturing a porous wick within such deviation ranges may be greatly reduced. In addition, when a porous wick is manufactured by packing a plurality of beads having such deviation ranges, a contact area between the beads may increase and thus the strength of the porous wick may be improved.

In addition, the size and/or packing structure of the bead may be determined based on the viscosity of a target aerosol-generating material. This is because it is necessary to increase the porosity of the wick in order to ensure an appropriate liquid transfer rate for an aerosol-generating material having a high viscosity. In this case, the target aerosol-generating material may refer to a material to be stored in a liquid storage tank. In some embodiments, a deviation range of the bead size may be adjusted based on the viscosity of the target aerosol-generating material. For example, when the viscosity of the target aerosol-generating material is greater than or equal to a reference value, the deviation range (i.e., tolerance) of the bead size may be reduced. This is because, when the deviation range of the bead size decreases, the size of the pore increases and the liquid transfer rate may increase. In an opposite case, the deviation range of the bead size may increase.

When a porous wick is implemented with a bead assembly, various advantages may be obtained as follows.

A first advantage is that a porous wick having a uniform size and distribution of pores may be easily manufactured and variations in quality of the porous wick may be reduced. In addition, the manufactured porous wick may ensure uniformity of the liquid transfer rate and the amount of liquid transfer, and thus, a burnt taste and damage to the porous wick may be prevented.

A second advantage is that the physical properties (e.g., porosity, pore size, pore distribution, and strength) of the porous wick may be easily controlled. This means that the liquid transfer capability of the porous wick may be easily controlled, because the physical properties of the porous wick are closely related to the liquid transfer capability (e.g., transfer rate and transfer amount) thereof. For example, the liquid transfer capability of the porous wick may be controlled by adjusting controllable factors such as the size, packing method, and/or packing structure of the beads.

The amount of atomization (i.e., the amount of aerosol generation) of an aerosol-generating device depends on the performance (e.g., heating strength) of a heater assembly and the liquid transfer capability of a wick, and accordingly, when the liquid transfer capability of the wick is poor even though the performance of the heater assembly is excellent, liquid may burn due to instantaneous liquid depletion. In addition, when the liquid transfer capability of the wick exceeds the performance of the heater assembly, a liquid that has not been vaporized may remain on the surface of the wick, thereby causing a leakage. Therefore, it is important that the liquid transfer rate of the wick and the performance of the heater assembly are controlled in a balanced manner. However, although the performance of the heater assembly may be easily controlled, it is not easy to control the liquid transfer capability of the wick. In this respect, a porous wick implemented with a bead assembly according to an embodiment may easily control the liquid transfer capability thereof, and thus the amount of atomization may be effectively increased.

Hereinafter, relationships between a bead size, a liquid transfer rate, and a wick strength will be made clearer through embodiments and comparative examples. However, the following embodiments are examples, and the scope of the present disclosure is not limited thereto.

First, the configurations of embodiments of the porous wick 15 and a comparative example compared thereto are shown in Table 1 below.

TABLE 1

| Classification | Type (manufacture method) | Bead diameter (μm) | Material |
|---|---|---|---|
| Embodiment 1 | Bead-based porous wick | 75-90 | Ceramic glass |
| Embodiment 2 | Bead-based porous wick | 90-105 | Ceramic glass |
| Embodiment 3 | Bead-based porous wick | 105-150 | Ceramic glass |
| Embodiment 4 | Bead-based porous wick | 150-180 | Ceramic glass |
| Comparative Example 1 | Fiber bundle-based wick | — | cotton |

Experimental Example 1 below is to clarify a relationship between the bead size and the liquid transfer rate, and Experimental Example 2 is to clarify a relationship between the bead size and the wick strength. Experimental Example 3 is to demonstrate the liquid transfer capability of a porous wick according to an embodiment. Hereinafter, each experimental example will be described.

Experimental Example 1: Comparison of Liquid Transfer Rates of Porous Wicks According to Embodiments 1 to 4

In the present experimental example, the liquid transfer rates of the porous wicks according to Embodiments 1 to 4 were measured, and experimental results thereof are shown in FIG. 12. As shown in FIG. 12, it may be seen that as the diameter of beads increases, the liquid transfer rate of the porous wick also increases. This is because the size (or porosity) of pores increases as the diameter of the beads increases. According to the present experimental example, it may be seen that the liquid transfer rate increases as the bead size increases, which denotes that the liquid transfer rate may be controlled by the bead size.

Experimental Example 2: Comparison of Strengths of Porous Wicks According to Embodiments 1 to 4

In the present experimental example, the yield loads of the porous wicks according to Embodiments 1 to 4 were measured, and experimental results thereof are shown in FIG. 13. As shown in FIG. 13, as the diameter of the bead increases, the mechanical strength of the porous wick decreases significantly. This is because as the size of the bead increases, the number of beads per unit volume decreases and the number of contact interfaces decreases during sintering.

Experimental Example 3: Comparison of Liquid Transfer Rates of Embodiment 1 and Comparative Example 1

Experimental Example 3 is for comparison of the liquid transfer capability of a fiber bundle-based wick (hereinafter, referred to as "fiber wick") generally used in a vaporizer with the liquid transfer capability of a porous wick according to an embodiment. In the present experimental example, a porous wick according to Embodiment 1, which has a lowest liquid transfer capability from among the above-described embodiments was selected and compared with the fiber wick. The transfer time was measured until the two wicks, that is, the porous wick and the fiber wick, were completely wetted by a liquid. In this experiment, the fiber wick has a cylindrical rod shape having a diameter of 2.0 mm and a length of 11 mm, and the porous wick has a rectangular parallelepiped shape having a height of 2.0 mm, a width of 2.0 mm, and a length of 11 mm. Experimental results according to the present experimental example are shown in Table 2 below.

TABLE 2

| Classification | Transfer time (sec) |
|---|---|
| Embodiment 1 | 3:03.28 |
| Comparative Example 1 | 2:23.49 |

As shown in Table 2, the transfer time of the porous wick according to Embodiment 1 was measured to be about 40 sec which is shorter than the transfer time of the fiber wick. This denotes that the liquid transfer capability of the porous wick according to the Embodiment 1 greatly exceeds the liquid transfer capability of the fiber wick. Putting the above experimental examples together, it may be seen that because the bead size greatly affects the strength and liquid transfer rate of the wick, it is preferable to determine the bead size by comprehensively considering a target strength and target transfer rate of the wick. In addition, as the bead size increases, the mechanical strength decreases relatively significantly. Therefore, it may be seen that it is preferable to set the bead size to a value as small as possible if the target transfer rate is satisfied. For example, because the porous wick according to Embodiment 1 has a higher strength than the porous wicks according to other embodiments while having a liquid transfer rate significantly higher than that of the fiber wick, it may be desirable to manufacture the porous wick according to Embodiment 1.

The bead size may be determined by further considering factors such as the performance of a heating element, the viscosity of a target aerosol-generating material, and the nicotine content of the target aerosol-generating material, in addition to the target strength and target transfer rate of the wick. In addition, the factors listed above may also be considered in determining the packing structure.

For example, a porous wick may be manufactured through a process of determining the diameter of a bead based on the viscosity of a target aerosol-generating material and a process of packing a plurality of beads having the determined diameter. In this case, the higher the viscosity of the target aerosol-generating material is, the larger the diameter of the bead may be determined. This is because the higher the viscosity is, the more it is necessary to increase the liquid transfer rate. In an opposite case, the diameter of the bead may be determined as a smaller value.

In the above example, the viscosity of the target aerosol-generating material may be proportional to a glycerin content and inversely proportional to a propylene glycol content. Thus, the bead size may be determined based on the glycerin content and/or the propylene glycol content.

As another example, the diameter of a bead may be determined based on the nicotine content of a target aerosol-generating material. In this case, the higher the nicotine content is, the smaller the diameter of the bead may be determined. Thus, the amount of nicotine transfer per puff may be limited. However, in other examples, the diameter of the bead may be determined as a larger value to increase the amount of nicotine transfer.

As another example, a porous wick may be manufactured through a process of determining a deviation range of the bead size or a packing structure based on the target strength of the porous wick, and a process of packing a plurality of beads having the determined deviation range according to the determined packing structure. In this case, as the target strength of the porous wick increases, the deviation range of the bead size may be determined as a larger value. This is because, when beads having various sizes are packed, a contact area may increase and the strength of the porous wick may increase. In addition, as the target strength of the porous wick increases, the packing structure may be determined as a more dense structure (e.g., a structure having a higher filling rate). This is because the strength of the porous wick may generally increase as the filling rate increases.

In some embodiments of the present disclosure, a process of reinforcing the strength of an outer edge portion of the porous body may be performed to improve the strength of the porous wick 15. This is because the outer edge portion does not significantly affect liquid absorption and plays an important role in maintaining the shape of the porous body, and thus, when the outer edge portion is strengthened, the overall strength of the porous wick 15 may be improved. The process of reinforcing the strength may be performed in a variety of ways. For example, the process of reinforcing the strength may be performed by a method of applying high density beads to a part to be reinforced, a method of applying a denser packing structure to a part to be reinforced, a method of packing, with beads having various sizes, a part to be reinforced, a method of applying other materials with high density to a part to be reinforced, or a method of packing, with beads having a smaller size, a part to be reinforced. However, the present disclosure is not limited thereto.

In the above, the porous wick 15, which is a bead assembly-based porous wick according to some embodiments of the present disclosure, has been described with reference to FIGS. 8 to 13. Hereinafter, a method of controlling a liquid transfer path of the porous wick 15 will be described. For convenience of description, it is assumed that the porous wick 15 has a rectangular parallelepiped body.

According to some embodiments of the present disclosure, a coating film may be formed on at least a portion of the body of the porous wick 15 in order to control the liquid transfer path of the porous wick 15. In more detail, in order to control a liquid to be transferred along a target transfer path, a coating film may be formed on at least some of a plurality of surfaces forming the body of the porous wick 15.

In this case, the coating film may block or limit the transfer (e.g. inflow and outflow) of the liquid, and the formation position of the coating film may be determined based on the target transfer path (or transfer direction) of the liquid. For example, the coating film may be formed on a surface not related to the target transfer path from among a plurality of surfaces forming the body of the porous wick 15. Further description will be made with reference to an example shown in FIG. 14. In FIG. 14, a perspective view of the porous wick 15 is shown on the left, and an unfolded view of the body of the porous wick 15 is shown on the right.

For example, it is assumed that a target transfer direction of a liquid is as shown in FIG. 14. In this case, the target transfer path passes through two surfaces 152 and 154 among a plurality of surfaces 151 to 156 forming the body of the porous wick 15. Accordingly, the surfaces 152 and 154 are surfaces related to the target transfer path, and a coating film may be formed on the other surfaces 151, 153, 155, and 156 except for the surfaces 152 and 154. Thus, the transfer of the liquid may be controlled to follow the target transfer path. That is, because the destination of the target transfer path is the heater assembly 16, the surface 154 associated with the heater assembly 16 is related to the target transfer path.

Until now, a method of controlling a liquid transfer path of the porous wick 15 according to some embodiments of the present disclosure has been described with reference to FIG. 14. As described above, a coating film may be formed on some surfaces not related to the target transfer path from among a plurality of surfaces forming the body of the porous wick 15. Accordingly, a liquid may be intensively transferred along the target transport path, and the liquid supply capability of the porous wick 15 and the atomization amount of the vaporizer (or aerosol-generating device) may be greatly increased.

Hereinafter, the aerosol-generating devices 100-1 to 100-3 to which the vaporizer 1 according to the embodiment may be applied will be described with reference to FIGS. 15 to 17.

FIGS. 15 to 17 are example block diagrams illustrating the aerosol-generating devices 100-1 to 100-3, respectively. Specifically, the aerosol-generating device 100-1 illustrated in FIG. 15 is a liquid aerosol-generating device, and the aerosol-generating devices 100-2 and 100-3 illustrated in FIGS. 16 and 17 are hybrid aerosol-generating devices using both a liquid and a cigarette.

As shown in FIG. 15, the aerosol-generating device 100-1 may include a mouthpiece 110, a vaporizer 1, a battery 130, and a controller 120. However, this is only an example, and some components may be added to or omitted from the aerosol-generating device 100-1, if necessary. In addition, the components of the aerosol-generating device 100-1 shown in FIG. 15 represent functional elements that are functionally distinguished from each other, and a plurality of components may be integrated with each other in an actual physical environment or a single component may be divided into a plurality of detailed functional elements. Hereinafter, each component of the aerosol-generating device 100-1 will be described.

The mouthpiece 110 may be located at one end of the aerosol-generating device 100-1, such that a user may inhale an aerosol generated from the vaporizer 1 through the mouthpiece 110. In some embodiments, the mouthpiece 110 may be a component of the vaporizer 1.

The vaporizer 1 may generate an aerosol by vaporizing a liquid aerosol-generating material. In order to avoid redundant descriptions, a description of the vaporizer 1 will be omitted.

The battery 130 may supply power used to operate the aerosol-generating device 100-1. For example, the battery 130 may supply power to allow a heater assembly (e.g., the heater assembly 16) of the vaporizer 1 to heat the aerosol-generating material, and may supply power required to operate the controller 120.

In addition, the battery 130 may supply power required to operate electrical components such as a display, a sensor, and a motor installed in the aerosol-generating device 100-1.

The controller 120 may control the overall operation of the aerosol-generating device 100-1. For example, the controller 120 may control the operations of the vaporizer 1 and the battery 130, and may also control the operations of other components included in the aerosol-generating device 100-1. The controller 120 may control power supplied by the battery 130 and a heating temperature of the heater assembly 16 included in the vaporizer 1. In addition, the controller 120 may determine whether the aerosol-generating device 100-1 is in an operable state by checking the state of each of the components of the aerosol-generating device 100-1.

The controller 120 may be implemented by at least one processor. The processor may be implemented as an array of a plurality of logic gates, or a combination of a general-purpose microprocessor and a memory in which a program executable in the microprocessor is stored. In addition, those of ordinary skill in the art to which the present disclosure pertains may clearly understand that the controller 120 may be implemented with other types of hardware.

In some embodiments, the aerosol-generating device 100-1 may further include an input unit (not shown) for receiving a user input. The input unit may be implemented as a switch or a button, but the scope of the present disclosure is not limited thereto. In the present embodiment, the controller 120 may control the aerosol-generating device 100-1 in response to a user input received through the input unit. For example, the controller 120 may control the aerosol-generating device 100-1 so that an aerosol is generated as a user operates the switch or button.

Hereinafter, the hybrid aerosol-generating devices 100-2 and 100-3 will be briefly described with reference to FIGS. 16 and 17.

FIG. 16 illustrates the aerosol-generating device 100-2 in which a vaporizer 1 and a cigarette 150 are arranged in parallel, and FIG. 17 illustrates the aerosol-generating device 100-3 in which a vaporizer 1 and a cigarette 150 are arranged in series. However, the internal structure of an aerosol-generating device to which the vaporizer 1 according to the embodiment of the present disclosure is applied is not limited to those illustrated in FIGS. 16 and 17, and the arrangement of components may be changed according to a design method.

In FIG. 16 or 17, the heater 140 may be arranged around the cigarette 150 to heat the cigarette 150. The heater 140 may be, for example, an electric resistive heater, but is not limited thereto. The heater 140 or the heating temperature of the heater 140 may be controlled by the controller 120. An aerosol generated by the vaporizer 1 may pass through the cigarette 150 and be inhaled into the mouth of the user.

Until now, various types of aerosol-generating devices 100-1 to 100-3 to which the vaporizer 1 according to some embodiments of the present disclosure may be applied have been described with reference to FIGS. 15 to 17.

In the above, even if all the components constituting the embodiments of the present disclosure have been described as being combined into one or operating in combination, the technical idea of the present disclosure is not necessarily limited to these embodiments. That is, within the scope of the objective of the present disclosure, all of the components may be selectively combined with each other.

At least one of the components, elements, modules or units (collectively "components" in this paragraph) represented by a block in the drawings such as the controller 120 in FIGS. 15-17 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Although the embodiments of the present disclosure have been described with reference to the accompanying drawings, those of ordinary skill in the art may understand that the present disclosure may be implemented in other specific forms without changing the technical spirit or essential features thereof. Therefore, it should be understood that the embodiments described above are illustrative in all respects and not limited. The scope of protection of the present disclosure should be interpreted by the following claims, and all technical ideas within a scope equivalent thereto should be construed as being included in the scope of the technical ideas defined by the present disclosure.

The invention claimed is:

1. A vaporizer comprising:

a liquid storage tank configured to store a liquid aerosol-generating material; and a wick-heater assembly comprising:

a porous wick configured to absorb the liquid aerosol-generating material through a porous body; and a heater assembly configured to heat the liquid aerosol-generating material absorbed by the porous wick, wherein the heater assembly comprises a heating pattern embedded in the porous body and having a flat shape, wherein the heating pattern is embedded at a position distanced from a center of the porous body, and wherein the heating pattern is embedded at a position which is 0 μm to 400 μm apart in an upward direction from a lower surface of the porous body.

2. The vaporizer of claim 1, wherein the heater assembly comprises one or more terminals electrically connected to a battery and arranged to be in close contact with the porous body.

3. The vaporizer of claim 1, further comprising:

an airflow pipe arranged above the wick-heater assembly and configured to transfer aerosol that is generated, wherein the heater assembly is arranged under the porous body to form the wick-heater assembly.

4. The vaporizer of claim 1, wherein the liquid storage tank is arranged above the wick-heater assembly, and wherein both sides of the porous body protrude in an upward direction into the liquid storage tank such that the liquid aerosol-generating material, which is stored in the liquid storage tank, is absorbed through the sides of the porous body.

5. The vaporizer of claim 1, wherein a coating film, which blocks or limits absorption of the liquid aerosol-generating material, is formed on a surface of at least a portion of the porous body, the surface of at least the portion of the porous body not being on an absorption path of the liquid aerosol-generating material that is stored in the liquid storage tank.

6. A vaporizer comprising:

a liquid storage tank configured to store a liquid aerosol-generating material;

a wick-heater assembly comprising:

a porous wick configured to absorb the liquid aerosol-generating material through a porous body; and a heater assembly configured to heat the liquid aerosol-generating material absorbed by the porous wick;

a wick housing located above the wick-heater assembly and coupled with the wick-heater assembly and the liquid storage tank; and a lower case located under the wick-heater assembly and coupled with the wick-heater assembly, wherein the lower case comprises a groove and the wick-heater assembly comprises a protruding member such that the lower case and the wick-heater assembly are coupled with each other by the protruding member being inserted into the groove.

7. The vaporizer of claim 6, wherein the liquid storage tank is arranged above the wick-heater assembly, and wherein both sides of the porous body protrude in an upward direction into the liquid storage tank such that the liquid aerosol-generating material, which is stored in the liquid storage tank, is absorbed through the sides of the porous body.

8. The vaporizer of claim 6, wherein a coating film, which blocks or limits absorption of the liquid aerosol-generating material, is formed on a surface of at least a portion of the porous body, the surface of at least the portion of the porous body not being on an absorption path of the liquid aerosol-generating material that is stored in the liquid storage tank.

9. A vaporizer comprising:

a liquid storage tank configured to store a liquid aerosol-generating material; and a wick-heater assembly comprising:

a porous wick configured to absorb the liquid aerosol-generating material through a porous body; and a heater assembly configured to heat the liquid aerosol-generating material absorbed by the porous wick, wherein the porous body is formed by a plurality of beads.

10. The vaporizer of claim 9, wherein each of the plurality of beads is a ceramic bead.

11. The vaporizer of claim 9, wherein a diameter of each of the plurality of beads is about 10 μm to about 300 μm.

12. The vaporizer of claim 9, wherein a diameter of each of the plurality of beads is about 70 μm to about 100 μm.

13. The vaporizer of claim 9, wherein a diameter distribution of the plurality of beads has deviations within 20% of an average diameter of the plurality of beads.

14. The vaporizer of claim 9, wherein a diameter of each of the plurality of beads is determined based on viscosity of the liquid aerosol-generating material.

15. The vaporizer of claim 9, wherein a diameter of each of the plurality of beads is determined based on a glycerin content in the liquid aerosol-generating material.

16. The vaporizer of claim 9, wherein the liquid storage tank is arranged above the wick-heater assembly, and wherein both sides of the porous body protrude in an upward direction into the liquid storage tank such that the liquid aerosol-generating material, which is stored in the liquid storage tank, is absorbed through the sides of the porous body.

17. The vaporizer of claim 9, wherein a coating film, which blocks or limits absorption of the liquid aerosol-generating material, is formed on a surface of at least a portion of the porous body, the surface of at least the portion of the porous body not being on an absorption path of the liquid aerosol-generating material that is stored in the liquid storage tank.

* * * * *